US009243770B2

(12) United States Patent
Schwaiger et al.

(10) Patent No.: US 9,243,770 B2
(45) Date of Patent: Jan. 26, 2016

(54) LIGHTING DEVICE HAVING A REFLECTOR AND AN APERTURE

(71) Applicant: OSRAM GmbH, Munich (DE)

(72) Inventors: Stephan Schwaiger, Ulm (DE); Oliver Hering, Niederstotzinger (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/390,796

(22) PCT Filed: Apr. 17, 2013

(86) PCT No.: PCT/EP2013/057979
§ 371 (c)(1),
(2) Date: Oct. 6, 2014

(87) PCT Pub. No.: WO2013/156518
PCT Pub. Date: Oct. 24, 2013

(65) Prior Publication Data

US 2015/0138799 A1 May 21, 2015

(30) Foreign Application Priority Data

Apr. 18, 2012 (DE) ..... 10 2012 206 397

(51) Int. Cl.
*F21S 8/10* (2006.01)
*F21V 29/505* (2015.01)

(52) U.S. Cl.
CPC ..... *F21S 48/1225* (2013.01); *F21S 48/1159* (2013.01); *F21S 48/13* (2013.01); *F21S 48/1388* (2013.01); *F21S 48/145* (2013.01); *F21S 48/1747* (2013.01); *F21S 48/321* (2013.01); *F21S 48/328* (2013.01); *F21V 29/505* (2015.01)

(58) Field of Classification Search
USPC ..... 362/84, 230, 231, 236, 242, 243, 247, 362/248, 516, 517, 518, 538, 539, 543, 544, 362/545
See application file for complete search history.

(56) References Cited

U.S. PATENT DOCUMENTS

| | | | |
|---|---|---|---|
| 6,736,524 | B2 | 5/2004 | Albou |
| 7,665,873 | B2 | 2/2010 | Eberhardt et al. |
| 7,963,684 | B2 | 6/2011 | Staub et al. |
| 8,573,802 | B2 | 11/2013 | Houg et al. |
| 2004/0136202 | A1 | 7/2004 | Ishida et al. |
| 2007/0058386 | A1 | 3/2007 | Albou |

(Continued)

FOREIGN PATENT DOCUMENTS

| | | | |
|---|---|---|---|
| DE | 60302708 | T2 | 9/2006 |
| DE | 102005025481 | A1 | 12/2006 |

(Continued)

OTHER PUBLICATIONS

International Search Report issued in PCT/EP2013/057979 dated Jul. 23, 2013.

*Primary Examiner* — Laura Tso
(74) *Attorney, Agent, or Firm* — Viering, Jentschura & Partner

(57) ABSTRACT

A lighting device may include a reflector, which can be illuminated by means of at least one light source, in particular light emitting diode, and an aperture disposed downstream of the reflector and having a rear side facing the reflector and a front side facing away from the reflector. The lighting device may include at least one additional light source for illuminating the front side of the aperture, and the front side of the aperture is covered at least in regions with at least one phosphor which is sensitive to light emitted by the at least one additional light source.

15 Claims, 7 Drawing Sheets

(56) References Cited

U.S. PATENT DOCUMENTS

| | | | | |
|---|---|---|---|---|
| 2013/0058114 | A1 | 3/2013 | Reiners | |
| 2013/0083553 | A1* | 4/2013 | Sekiguchi | 362/517 |
| 2013/0308328 | A1* | 11/2013 | Rice et al. | 362/516 |
| 2014/0133169 | A1* | 5/2014 | Schwaiger et al. | 362/516 |

FOREIGN PATENT DOCUMENTS

| | | | |
|---|---|---|---|
| DE | 102006057748 | A1 | 6/2008 |
| DE | 102007049309 | A1 | 4/2009 |
| DE | 102007063542 | A1 | 7/2009 |
| DE | 102009012138 | A1 | 9/2010 |
| DE | 102010028949 | A1 | 11/2011 |
| DE | 102010062463 | A1 | 6/2012 |
| EP | 2184532 | A2 | 5/2010 |
| EP | 2320128 | A2 | 5/2011 |
| EP | 1369639 | A1 | 12/2013 |
| FR | 2933167 | A1 | 1/2010 |
| WO | 2010100010 | A1 | 9/2010 |

* cited by examiner

LIGHTING DEVICE HAVING A REFLECTOR AND AN APERTURE

RELATED APPLICATIONS

The present application is a national stage entry according to 35 U.S.C. §371 of PCT application No.: PCT/EP2013/057979 filed on Apr. 17, 2013, which claims priority from German application No.: 10 2012 206 397.8 filed on Apr. 18, 2012, and is incorporated herein by reference in its entirety.

TECHNICAL FIELD

Various embodiments generally relate to a lighting device, including a reflector, which may be illuminated by means of at least one light source, in particular light emitting diode, and a diaphragm disposed downstream of the reflector and having a rear side facing the reflector and a front side facing away from the reflector. This lighting device is suitable in particular for vehicles, in particular motor vehicles, in particular in connection with headlights.

BACKGROUND

In the case of headlights for automobiles and trucks, in order to generate a low beam, a diaphragm ("shutter") is introduced into a beam path between a reflector and a lens of the headlight. The diaphragm blocks a portion of the light rays passing from the reflector to the lens, with the result that a sharp bright-dark boundary arises in the light emission pattern generated behind the lens in the far field. For headlights having an additional function, e.g. that of a high beam, a movable diaphragm has been used hitherto, one or the other light function being provided by the headlight depending on the position of the diaphragm. However, this arrangement is comparatively complex and in addition susceptible to wear.

US 2007/058386 relates to a method for producing a headlight module for a motor vehicle which emits a beam having a cut-off edge for producing a bright-dark boundary, including a lens and a light source in a rear region of the lens, from which it is separated by air in its arrangement, wherein the light source is formed by means of at least one LED, according to which the exit surface of the lens is chosen such that it can be connected to the exit surfaces of similar, adjacent modules at a smooth continuous surface, and the entrance surface of the lens is shaped such that the cut-off edge of the light beam is generated without a shielding diaphragm.

US 2004/136202 A1 discloses a vehicle headlight which uses a light emitting element, such as an LED, and has a projected light pattern. A light emitting surface of the light emitting element has a horizontally elongated form when viewed in a direction perpendicular to the optical axis of the light emitting element, in order thus to form a light distribution pattern which is magnified by an optical system, to be precise principally in a horizontal direction. Since the projected pattern is obtained by a magnification of the horizontally elongated light source, in this case it is easier to adapt the light distribution of the lamp than for the case where the light intensity distribution of the light emitting element is rotationally symmetrical.

SUMMARY

Various embodiments provide a lighting device including a reflector, which may be illuminated by means of at least one light source ("primary light source"), and a diaphragm disposed downstream of the reflector and having a rear side facing the reflector and a front side facing away from the reflector. The lighting device includes at least one additional light source for illuminating the front side of the diaphragm. The front side of the diaphragm is covered at least in regions with at least one phosphor which is sensitive to light emitted by the at least one additional light source.

This lighting device has the advantage that at least one further light function may be provided without complex structural modification of the conventional lighting device, since the light emitted by the at least one phosphor correspondingly modifies the light emission pattern. The diaphragm need not (but may optionally) be embodied as movable for this purpose, with the result that the lighting device may be implemented in a manner free of wear. The positioning of the at least one additional light source and of the at least one phosphor is highly flexible and thus enables a varied construction and varied light emission patterns (high freedom of design). Moreover, the light emission (partial) pattern emitted by the phosphor may be shaped particularly precisely.

The fact that the at least one phosphor is sensitive to light emitted by the at least one additional light source may mean, in particular, that said phosphor is designed to convert (primary) light emitted by said additional light source into at least one (secondary) light having a different, in particular longer, wavelength or color relative thereto.

The rear side of the diaphragm facing the reflector may also be regarded as that side which may be directly irradiated or illuminated by the reflector. Analogously, the front side of the diaphragm may be, in particular, a side which cannot be directly irradiated or illuminated by the reflector.

In one development, the at least one primary light source and/or the at least one additional light source are/is configured as semiconductor light source(s). The at least one semiconductor light source may include at least one laser, in particular semiconductor laser such as a laser diode, and/or at least one light emitting diode.

The at least one light emitting diode may be present in the form of at least one individually packaged light emitting diode or in the form of at least one LED chip. A plurality of LED chips may be mounted on a common substrate ("submount"). The at least one light emitting diode may be equipped with at least one dedicated and/or common optical unit for beam guiding, e.g. at least one Fresnel lens, collimator, and so on. Instead of or in addition to inorganic light emitting diodes, e.g. based on InGaN or AlInGaP, generally organic LEDs (OLEDs, e.g. polymer OLEDs) may also be used.

By way of example, a plurality of additional light sources may radiate from different directions onto the front side covered with the at least one phosphor.

In one development, a lens is disposed downstream of the reflector and the diaphragm. In particular, light radiated into the lens directly from the reflector and also light generated by the phosphor of the front side of the diaphragm may radiate through the lens. The diaphragm, since it may block part of the light reflected by the reflector, may also be regarded as being interposed between the reflector and the lens.

In one configuration, the diaphragm has a cut-off edge (i.e. an edge for generating the bright-dark boundary) for light reflected by the reflector. The cut-off edge may correspond, in particular, to an upper edge or an upper margin of the front side or a transition between the front side and a top side of the diaphragm. As a result, a sharp bright-dark boundary may be generated in the associated light emission pattern, which may be advantageous e.g. for generating a low beam.

In one development, the cut-off edge lies on a principal plane of the reflector at least in sections.

This results in a sharp bright-dark boundary at the widest location of the light emission pattern.

In another configuration, the at least one phosphor adjoins a top side of the front side or the cut-off edge at least in sections. As a result, a ("second") part—generated by the phosphor of the front side of the diaphragm—of the light emission pattern with high brightness may be brought to the ("first") part—generated by the light reflected by the reflector—of the light emission pattern. In this regard, (at least in sections) a dark stripe in the light emission pattern between these two parts may be kept narrow or even completely avoided.

In a further configuration, a top side of the diaphragm is covered at least in sections with the at least one phosphor. By virtue of the top side (often embodied as a narrow side) being covered (at least in sections, but also completely), a non-illuminated or only slightly illuminated stripe possibly still present between the first part of the light emission pattern and the second part of the light emission pattern may be illuminated and the dark stripe therebetween may thus be particularly effectively minimized or even completely eliminated.

In yet another configuration, the front side of the diaphragm is covered only partly with the at least one phosphor. This affords the advantage that the second part of the light emission pattern that may be generated thereby may be embodied particularly diversely, e.g. by means of an edge of the phosphor that is shaped arbitrarily at the front side of the diaphragm.

In one configuration, moreover, the front side of the diaphragm is covered with locally different, in particular mutually separated, regions of the at least one phosphor. As a result, even mutually separated second parts or partial regions of the light emission pattern or a plurality of local brightness islands may be generated, which allows an even more diverse light emission pattern to be generated.

Very generally, the form of the covering with the at least one phosphor is not restricted and may have in particular one or a plurality of patterns. In this regard, the phosphor may be applied in the form of strips (of identical or different widths), matrix-like arrays, prints, rings, lattices, etc. Alternatively or additionally, such patterns may be present as cutouts of a phosphor surface.

The phosphor may be present in particular as a layer, e.g. as a mono- or multilayer system, in particular including a laminate.

The phosphor may for example be printed onto the diaphragm, be applied e.g. by blade coating, by means of a film, e.g. electroluminescent film, or be coated by means of a layer including phosphor as filler, e.g. silicone layer.

In one configuration, in addition, the at least one phosphor has a thickness that differs over its area. In this regard, different color loci of the light emitted by the phosphor may be set. As a result in turn it is possible to compensate, for example, for a color segregation as a result of a chromatic aberration upon the passage of the mixed light (e.g. a generation of color fringes) through a lens. In this case, it is possible, in particular, to make use of the effect that a primary light (e.g. blue or ultraviolet light) incident from the at least one additional light source may actually only be partly converted by the phosphor ("partial conversion"). The degree of conversion is dependent, inter alia, on a density of the at least one phosphor and/or its thickness, in particular layer thickness. Given a constant density, the degree of conversion increases all the more strongly, the greater the thickness of the phosphor, in particular phosphor layer. If e.g. the phosphor converts the blue primary light into yellow secondary light, the thickness of the phosphor may be set locally such that partly white mixed light, partly bluish mixed light and/or partly yellowish mixed light is generated. Given a sufficiently high degree of conversion ("full conversion") purely yellow light regions may also be generated.

In one development, the front side of the diaphragm or the main body thereof, on which the phosphor lies, is embodied as absorbent. In this regard, in particular (e.g. blue or ultraviolet) primary light impinging thereon may be suppressed.

By contrast, the converted secondary light is typically emitted isotropically or non-directionally by the phosphor.

In one development which is preferred for generating a particularly high degree of conversion or for setting a defined primary light proportion, the front side of the diaphragm is embodied as (specularly or diffusely) reflective.

In one configuration, in addition, the lighting device includes a plurality of additional light sources having different wavelengths of the light emitted by them for illuminating the front side of the diaphragm, and the front side of the diaphragm is covered at least in regions with a plurality of phosphors which are selectively sensitive to the light emitted by the additional light sources. In this regard, different second parts of the light emission pattern may be generated by means of the front side of the diaphragm.

By way of example, the front side may be covered with a first phosphor, which is ("selectively") sensitive to primary light from at least one first additional light source, but not to primary light from at least one second additional light source. The front side may furthermore be covered with a second phosphor, which is (selectively) sensitive to the primary light from the at least one second additional light source, but not to the primary light from the at least one first additional light source. As a result, a respective second part of the light emission pattern may be generated by activation of the first light source(s) and/or of the second light source(s). The first phosphor may cover an identical or a different, if appropriate also overlapping, region of the front side of the diaphragm in comparison with the second phosphor.

However, the lighting device is not restricted thereto and may include e.g. more than two different phosphors and/or different additional light sources.

The mixed light—emitted by the first phosphor—including first primary light and first secondary light of the first phosphor may have an identical or similar cumulative color locus in comparison with the mixed light—emitted by the second phosphor—including second primary light and second secondary light of the second phosphor.

Generally, a phosphor may also be sensitive to primary light of different colors or from different additional light sources, i.e. subject the light thereof to wavelength conversion.

In one configuration, moreover, the plurality of phosphors cover at least partly mutually different regions of the diaphragm. In this regard, in particular even differently shaped and/or differently positioned second parts of the light distribution pattern may be generated in a simple manner.

In one configuration which is preferred for precise and particularly stable application even of relatively thick phosphor layers, the at least one phosphor is introduced into at least one depression of the front side.

In another configuration, the reflector is embodied as a half-shell reflector. This enables a particularly cost-effective and compact lighting device.

In yet another configuration, the light reflected by the reflector forms a function light (e.g. low beam) of the lighting device, and the light emitted by the at least one phosphor at least concomitantly forms a further function light of the lighting device (e.g. a high beam). Consequently, at least one additional function light may be generated by simple irradiation of the front side of the diaphragm, and thus also without the movement thereof or the like.

In a further configuration, the reflector is embodied as a full-shell reflector, which is divided into two (in particular half-shell-shaped) parts by the diaphragm. By means of the phosphor of the front side of the diaphragm, it is thus possible to brighten in particular a relatively dark boundary between the two ("first") parts of the light emission pattern. This configuration may also be interpreted such that the lighting device includes two half-shell reflectors which are arranged in a mirror-inverted fashion and which are separated from one another by the diaphragm. These half-shell reflectors need not be embodied identically. The diaphragm preferably lies on a common principal plane of the two half-shell reflectors.

In one configuration, furthermore, the diaphragm is embodied as a heat spreading body. As a result, separate mounting of a dedicated heat spreading body may be dispensed with. Moreover, this type of heat spreading is particularly effective. The combined component thus performs both the lighting function of the diaphragm or of the shutter and the thermal function of a heat spreading body. In particular, the heat ("Stokes heat") generated by the at least one phosphor during wavelength conversion may thus be spread and dissipated more effectively.

In one development, moreover, the diaphragm widens from its top side. The top side may form the bright-dark boundary, in particular. A comparatively narrow top side enables a precise bright-dark boundary or beam cut-off, to be precise even in the case of a diaphragm arranged in a slightly angled or tilted manner. The widening from said top side results in an improved thermal conductivity and thus also better heat spreading. From the top side, the diaphragm may widen for example cross-sectionally triangularly or in a curved fashion on one side or on two sides.

In one configuration, moreover, the diaphragm is configured as a heat sink and/or is connected to a heat sink in a highly thermally conductive manner. As a result, waste heat may be dissipated particularly effectively from semiconductor light sources fitted on the diaphragm. For this purpose, the diaphragm, for example at surfaces which are not relevant optically (which in particular do not block any light), may have at least one cooling structure, e.g. cooling ribs, cooling lamellae, cooling pins, etc., and/or be embodied such that a high emission of heat is achieved there, e.g. by virtue of lacquering or anodizing. Particularly an integral configuration of the diaphragm as a heat sink has the advantage of effective heat spreading and heat dissipation since no contact areas or transition regions that inhibit the heat propagation are present. Moreover, mounting is facilitated particularly for this case. However, the diaphragm or the diaphragm/heat spreading body combination component may also be connected to a separately produced heat sink in a highly thermally conductive manner, e.g. by means of a direct contact (for example by means of an interface material having good thermal conductivity, e.g. a TIM "thermal interface material", such as a thermally conductive paste, or by means of at least one heat pipe. As an alternative thereto, the diaphragm itself may include a function as a heat pipe or be a heat pipe.

The reflector may furthermore have an open side (e.g. underside) which does not constitute a light exit opening, and the diaphragm may at least partly cover said open side. In this regard, the diaphragm may be embodied as particularly voluminous and effectively heat-dissipating. The diaphragm may be embodied as specularly or diffusely reflective at least in regions at its surface covering said open side of the reflector. The diaphragm may have at least one semiconductor light source at its surface covering said open side of the reflector. Said at least one semiconductor light source may be designed to emit its light at least partly onto the reflector.

In one development, in addition, the rear side of the diaphragm is arranged at a part of a light exit opening of the reflector. As a result, the diaphragm may be fixed to an edge of the reflector in a simple manner and with high mounting accuracy. In addition, an accurately defined light beam may thus be output substantially without light losses.

In one development, furthermore, at least one (further) semiconductor light source is fitted to the front side of the diaphragm. As a result, a (further) light emission pattern may also be generated, which is not influenced by the diaphragm. In this regard, in particular in relation to a vehicle headlight, the diaphragm may generate a bright-dark boundary for a low beam (emitted by the semiconductor light sources arranged on the rear side of the diaphragm), while the at least one semiconductor light source fitted on the front side of the diaphragm generates a daytime running light without a bright-dark boundary or the like.

Generally, if a plurality of semiconductor light sources are present on the diaphragm, they may be subdivided into one or a plurality of groups that may be activated jointly in each case. A group may include in each case one or a plurality of semiconductor light sources. A semiconductor light source may be assigned to one or a plurality of groups. It is thus possible to generate different light emission patterns by activating different groups. A light emission pattern may be changed for example by activation of different groups of semiconductor light sources or by activation or deactivation of one or a plurality of groups. By way of example, one group of a plurality of light emitting diodes arranged on the rear side of the diaphragm may generate a low beam, and a high beam may be generated by the switching on of a further group of light emitting diodes arranged on the rear side of the diaphragm. Moreover, the light emitting diodes arranged on the rear side of the diaphragm may be switched off for the purpose of switching over to a daytime running light and light emitting diodes arranged on the front side of the diaphragm may be activated instead of them.

In another configuration, the reflector (or its reflective inner side or inner wall) has an at least approximately ellipsoidal basic shape. In this regard, a light emission pattern of the reflector is achieved which may be locally delimited to a particularly great extent and thus enables a particularly compact and highly beam-shaping arrangement. Moreover, in this case, the diaphragm may enable a sharp, high-contrast bright-dark boundary in a simple manner. However, the lighting device is not restricted thereto and may e.g. also include a parabolic or freeform shaped or free-areally shaped reflector. The reflector may be divided in particular into different regions (facets), e.g. vertically and/or horizontally into different regions, which may be divided as a percentage depending on shape.

It may be particularly advantageous for an inner region of the reflector near the optical axis to be shaped spherically or elliptically, while an outer region further away from the optical axis has a different basic shape, e.g. non-spherical or non-elliptic, since the outer regions, on account of large angles of the rays with respect to the optical axis, may be utilized more poorly in terms of lighting for downstream imaging with a spherical reflection region. The outer regions may be embodied for example as elliptic (in particular in the case of a spherically embodied inner region) or as freeform (in particular in the case of an elliptically embodied inner region).

In yet another configuration, the lighting device is a vehicle lighting device, in particular headlight. In this case, in particular, the bright-dark boundary and the scattered light generation or operation with two (or more) functions may be used advantageously, in particular at least for generating a low beam.

The lighting device may generally include one or a plurality of optical elements disposed downstream of the shell reflector, e.g. one or a plurality of lenses, further reflectors, light-transmissive covers, etc.

The type of vehicle is not restricted and may encompass for example waterborne vehicles (ships, etc.), airborne vehicles (airplanes, helicopters, etc.) and landborne vehicles (e.g. automobiles, trucks, motorcycles, etc.).

BRIEF DESCRIPTION OF THE DRAWINGS

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

DETAILED DESCRIPTION

The following detailed description refers to the accompanying drawing that show, by way of illustration, specific details and embodiments in which the disclosure may be practiced.

Figure 1:
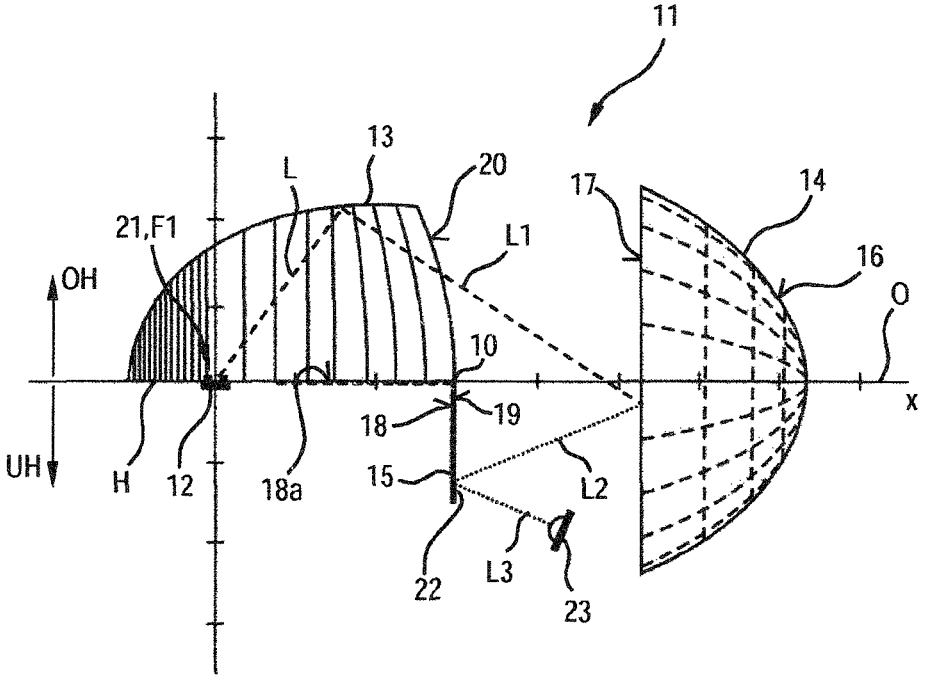
FIG. 1 shows a first vehicle lighting device as a sectional illustration in side view.
Figure 2:
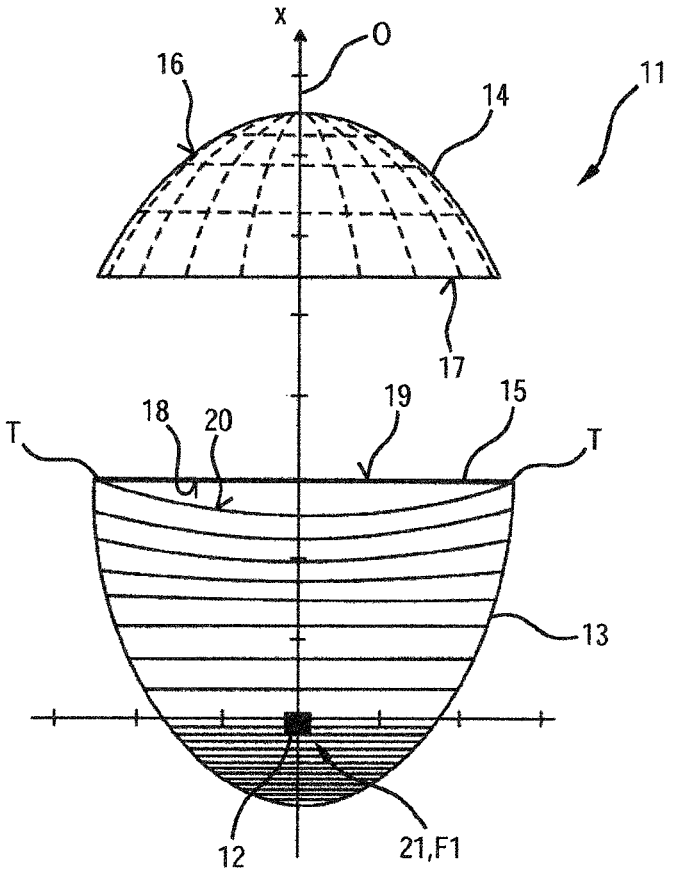
FIG. 2 shows the first vehicle lighting device as a sectional illustration in plan view.

FIG. 1 shows a vehicle lighting device 11 as a sectional illustration in side view, which vehicle lighting device is suitable in particular for use as a headlight of a motor vehicle. FIG. 2 shows the vehicle lighting device 11 in a plan view.

The vehicle lighting device 11 includes at least one light generating unit 12, an approximately ellipsoidal reflector 13, a lens 14 and a diaphragm 15. These elements may be accommodated in a dust- and/or moisture-tight housing arrangement (not illustrated).

The reflector 13 is designed here purely by way of example as a half-shell reflector having an approximately ellipsoidal freeform shaped reflection surface. A front edge 20 of the reflector 13 is curved laterally toward the front and ends at points T, as shown in FIG. 2. A lower edge of the reflector 13 lies on the plane which also represents a principal plane H of the reflector 13. The reflector 13 has a main body composed of plastic with a specularly reflective reflection surface at its inner side.

The reflector 13 has an internal focal point F1 overarched by the reflector 13 and an external focal point (not illustrated) A light exit surface (not illustrated) of the light generating unit 12 is situated in the region of the internal focal point F1. The internal focal point F1 may also be regarded as a focal spot on account of the light exit surface not being negligibly small. The light generating unit 12 here includes conversion light emitting diodes 21, which emit white light L or blue-yellow mixed light. By way of example, a diffuser may be disposed downstream of the conversion light emitting diodes 21. When the light emitting diodes are activated or the light generating unit 12 is activated, the light L emerging at the light exit surfaces of the light emitting diodes 21 is radiated into the reflector 13. The reflector 13 is therefore disposed optically downstream of the light generating unit 12.

The lens 14 disposed optically downstream of the reflector 13 has an aspherical shape and is embodied as rotationally symmetrical about its optical axis O. The optical axis O is depicted here as lying horizontally. The lens 14 thus has a planoconvex basic shape, wherein a convex, front surface 16 has a spherical shape and a planar, rear surface 17 is perpendicular to the optical axis O, which here coincides with the x-axis. The lens 14 consists of PMMA. A diameter of the lens 14 perpendicular to the optical axis O (which corresponds to a circle diameter of the rear surface 17) here is approximately 50 mm given a thickness along the optical axis O of approximately 20 mm. A length of the vehicle lighting device 11 is, in particular, between 80 mm and 90 mm.

A horizontal plane, the principal plane H, in which the optical axis O of the lens 14 lies, divides the illustrated space imaginarily into an upper half-space OH and a lower half-space UH. While half of the lens 14 is situated in the upper half-space OH and the other half is situated in the lower half-space UH, the reflector 13 is situated in the upper half-space OH and the diaphragm 15 is situated in the lower half-space UH.

The diaphragm 15 is partly interposed into a beam path between the reflector 13 and the lens 14. The diaphragm 15, which is therefore optically interposed between the reflector 13 and the lens 14, has a side ("rear side") 18 which faces the reflector 13 and which may be directly irradiated or illuminated by the reflector 13. The diaphragm 15 furthermore has a side ("front side") 19 which faces away from the reflector 13 and which cannot be directly irradiated or illuminated by the reflector 13. Consequently, one part of the light L reflected by the reflector 13 is blocked by the rear side 18 of the diaphragm 15 and another part L1 is radiated directly onto and through the lens 14. The rear side 18 of the diaphragm 15 may be configured such as it is in particular light-nontransmissive, in particular light-absorbing. In this variant, the diaphragm 15 is configured as a perpendicular plate.

A (narrow) top side 10 of the diaphragm 15 forms a cut-off edge, which here touches the optical axis O. The diaphragm 15, by means of the top side 10, generates a bright-dark boundary G in the image or light emission pattern projected by the lens 14 (see FIG. 3), said bright-dark boundary being of the kind prescribed for example for operation of a motor vehicle in road traffic. The second, external focal point of the reflector 13 may be situated at the point of intersection between the optical axis O and the top side 10. The second focal point may generally correspond in particular to a focal point of the lens 14. Since the external focal point here lies between the reflector 13 and the lens 14, only a part of the rear side 17 of the lens 14 that lies in the lower half-space UH is irradiated by the light L1 incident from the reflector 13. The light emission pattern projected behind the lens 14 (i.e. in the direction of the x-axis) has in the far field the bright-dark boundary G at its upper edge.

In one variant, the diaphragm 15 has a rear side 18*a* (depicted by dashes) which lies horizontally on the principal plane H of the reflector 13 and thus at least partly represents the base thereof. The rear side 18*a* is perpendicular to the front side 19. In this variant, in particular, the rear side 18*a* may e.g. also be reflective, in particular reflectively coated.

The vehicle lighting device 11 furthermore includes, on the front side of the diaphragm 15, a phosphor layer 22 bearing over the whole area, e.g. including a phosphor that converts the blue (primary) light into yellow (secondary) light. Furthermore, at least one additional light source in the form of at least one additional light emitting diode 23 which emits blue primary light L3 is provided (only shown in FIG. 1) for illuminating the phosphor layer 22. The (primary) light L3 emitted by said at least one light emitting diode 23 is partly converted by the phosphor layer 22, and the blue-yellow, in particular white, mixed light L2 ultimately emitted by the phosphor layer 22 is reflected diffusely into the lens 14.

Figure 3:
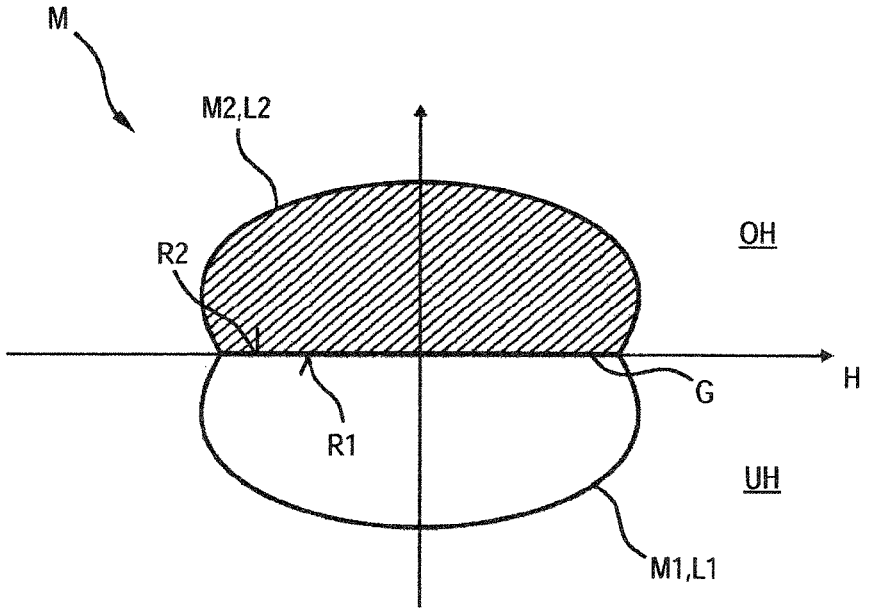
FIG. 3 shows a frontal view of a light emission pattern generated behind the vehicle lighting device.

FIG. 3 shows a frontal view of a light emission pattern M generated in the far field along the optical axis O behind the lens 14 by the vehicle lighting device 11. A lower region M1 of the light emission pattern M situated below the principal plane H has a sharp bright-dark boundary G at its upper edge R1 and is generated by the light L1 that passes directly from the reflector 13 into the lens 14. An upper region M2 of the light emission pattern M situated above the principal plane H adjoins the bright-dark boundary G at its lower edge R2 and is generated by (mixed) light L2 that is radiated from the phosphor layer 22 into the lens 14. By way of example, the lower region M1 of the light emission pattern M may provide a low beam or such a function, and the two regions M1 and M2 may jointly provide a further light function e.g. in the form of a high beam.

Without further measures, the bright-dark boundary G may remain as a dark stripe between the two regions M1 and M2 or their edges R1 and R2.

Although the lower region M1 and the upper region M2 of the light emission pattern M are similar here in terms of their shape, this is not necessarily the case, and in particular the shape and brightness distribution of the upper region M2 generated by the phosphor layer 22 may be adjustable in its shape in a comparatively simple manner.

Particularly if the light generating unit 12 and/or the at least one light emitting diode 23 are/is dimmable, in particular dimmable independently of one another, it is possible moreover to provide a light emission pattern M having a brightness that is reduced overall, but also in only one of the regions M1 or M2. By way of example, a brightness of the region M2 which may be generated by the phosphor layer 22 may thus be matchable to a brightness of the region M1, in particular for generating at least one new light function.

The light emission pattern M or the regions M1 and/or M2 thereof may have, in particular marginally, a color fringe resulting from a chromatic aberration upon the light L1 and L2 passing through the lens 14. The color fringe brings about, in particular, a color separation of the individual colors yellow and blue of the mixed light, such that the color fringe may be e.g. a yellow-blue color fringe.

Figure 4:
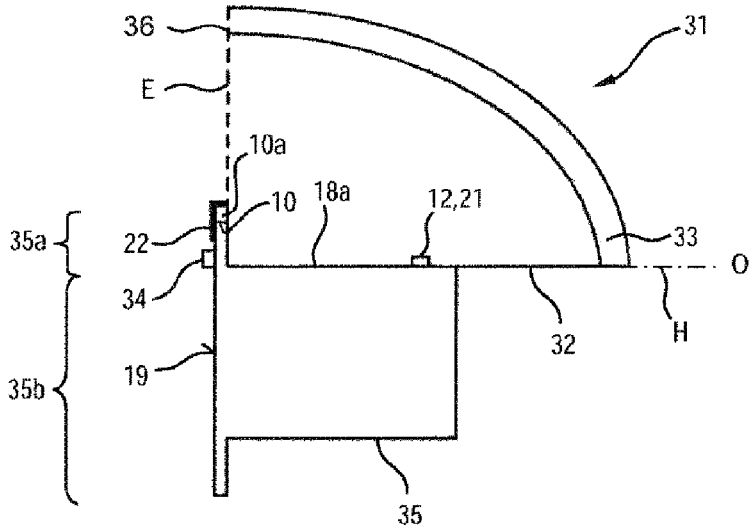
FIG. 4 shows a second lighting device as a sectional illustration in side view.
Figure 5:
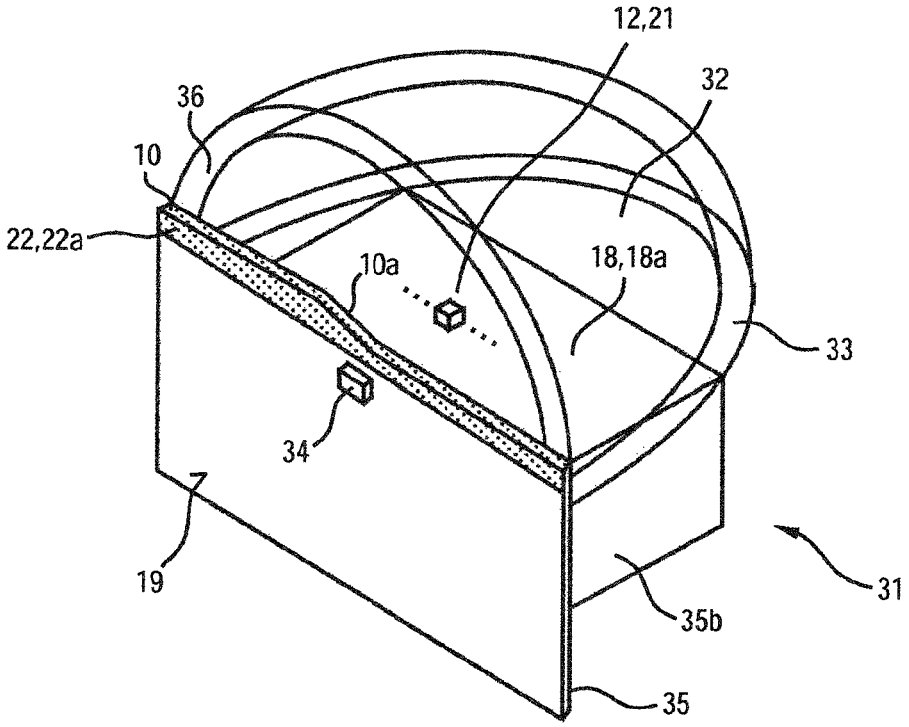
FIG. 5 shows the second lighting device in a view obliquely from the front.

FIG. 4 shows, as a sectional illustration in side view, a lighting device 31 in accordance with a second embodiment, which lighting device may be used in particular as a vehicle headlight or as a part thereof. FIG. 5 shows the lighting device 31 in a view obliquely from the front. In the case of the illustration of the lighting device 31, the lens and the at least one additional light emitting diode are not shown, but are typically present.

The lighting device 31 also includes a reflector 33 in the form of a half-shell reflector having an open underside 32.

The diaphragm 35, now also serving as a heat spreading element, is shaped such that, in a region 35*a*, it covers a light exit opening E (formed by a front edge 36) of the reflector 33. At the adjacent region 35*b* situated below the underside 32, the diaphragm 35 is thickened in a rearward direction to such a great extent that it at least partly covers the underside 32 of the reflector 33. If the region 35*b* does not completely cover the underside 32, the latter may be covered e.g. by a dedicated cover, e.g. a reflective plate.

On a top side 18*a* of said region 35*b* (which may be diffusely or specularly reflective), the at least one light emitting diode 21 is situated at the internal focal point or focal spot of the reflector 33.

The narrow top side 10—forming a cut-off edge or optical edge—of the region 35*a* is not configured rectilinearly here, but rather has an oblique step 10*a* in its center, such that the top side 10 is higher at one half than at the other half. An asymmetrical light emission pattern may thereby be obtained in a simple manner.

Phosphor in the form of at least one phosphor layer 22, 22*a* is applied on the front side 19 of the diaphragm 35. The phosphor layer 22, 22*a* here covers the front side 19 only partly, to be precise an upper part of the upper region 35*a* over the entire width thereof. As a result of irradiation by at least one additional light emitting diode 23 (not illustrated), the upper region M2 of the light emission pattern M may thus be generated. In order to brighten the dark stripe that possibly exists otherwise between the two regions M1 and M2 or their edges R1 and R2, the top side 10 of the diaphragm 35 is also completely covered with the phosphor layer 22, 22*a*. In other words, the phosphor layer 22, 22*a* may extend right onto the top side 10.

The diaphragm 35 is embodied as a compact, large-volume heat spreading body in order to dissipate heat generated by the light emitting diodes 21 and by the phosphor layer 22, 22*a*. As a result of the large volume and the only short region 35*a*, the diaphragm 35 enables effective heat spreading. The large volume additionally makes it possible, in a particularly simple manner, to provide a considerable part of its surface area with a heat sink structure, e.g. with cooling ribs, cooling pins, etc., or else with a coating that improves heat convection, e.g. a lacquering. For this purpose, the diaphragm 35 furthermore consists of a material having good thermal conductivity (with a value of more than 15 W/(m·K)), e.g. composed of aluminum. The diaphragm 35 may be attached to a dedicated heat sink (not illustrated) for particularly effective heat dissipation, for example by its underside, in particular via a material having good thermal conductivity, such as a TIM ("thermal interface material").

Furthermore, at least one (optional) light emitting diode 34 is also fitted at the front side 19 of the diaphragm 35. Consequently, said light emitting diode 34 does not radiate into the reflector 33, nor is its light being influenced or shaped by the diaphragm 35. Said light emitting diode 34 may fulfill a different light function than the light emitting diodes 21, e.g. a daytime running light function. The light emitting diode 34 may be activated for example in addition to or instead of the light emitting diodes 21.

Figure 6:
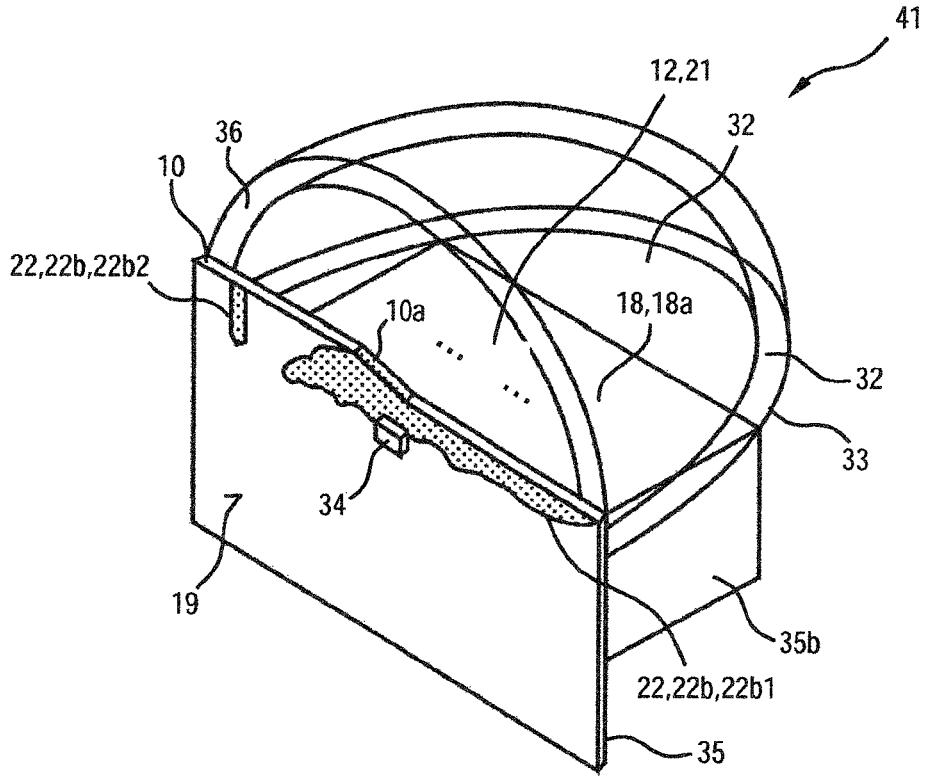
FIG. 6 shows a third lighting device in a view obliquely from the front.

FIG. 6 shows a third lighting device 41 in a view obliquely from the front. The third lighting device 41 differs from the second lighting device 31 in the configuration of the phosphor layer 22, 22*b*. Specifically, the phosphor layer 22*b* is not continuous, but rather divided into a plurality of partial regions 22*b*1 and 22*b*2. Moreover, the top side 10 is no longer completely covered with the phosphor layer 22*b*, but rather only on its oblique step 10*a*. As a result, a differently shaped upper region M2 of the light emission pattern M is formed in a simple manner.

Very generally, and e.g. also in the case of the lighting devices 11, 31 and/or 41, what results from the (optional) configuration of the phosphor layer 22 is that the latter at least in sections is adjacent up to the top side 10 of the diaphragm (and thus as far as an upper edge of the front side 19), with the result that a possibly remaining dark stripe in the region of the bright-dark boundary G remains narrow.

Very generally, and e.g. also in the case of the lighting devices 11, 31 and/or 41, the phosphor layer 22 may have at least in regions a thickness that differs over its area, in particular marginally. As a result, in particular marginally, the color locus of the mixed light is shifted between yellow and blue, such that a yellowish or bluish light may be set e.g. locally in a targeted manner. As a result in turn, a color segregation on account of a chromatic aberration upon the mixed light L1, L2 passing through the lens 14 may be compensated for in a targeted manner.

Moreover, the lighting devices 11, 31 and/or 41 in one variant may include a plurality of different additional light emitting diodes having different wavelengths (e.g. blue with 440 nm and blue with 480 nm) of the light emitted by them for illuminating the front side 19 of the diaphragm 15 or 35. The front side 19 of the diaphragm 15, 35 may then be covered for example at least in regions with a plurality of different phosphors which are selectively sensitive to the light emitted by the additional light sources. In the case of the lighting device 41, by way of example, the partial region 22*b*1 may be covered with a first phosphor and the partial region 22*b*2 may be covered with a second phosphor. The partial regions 22*b*1 and 22*b*2 may be selectively activatable by optional activation of the different additional light emitting diodes. Mixed light having an identical or similar cumulative color locus, e.g. cold-white between 5000K and 6000K, may then be emitted by the partial regions 22*b*1 and 22*b*2, or the cumulative color loci may differ appreciably.

Figure 7:
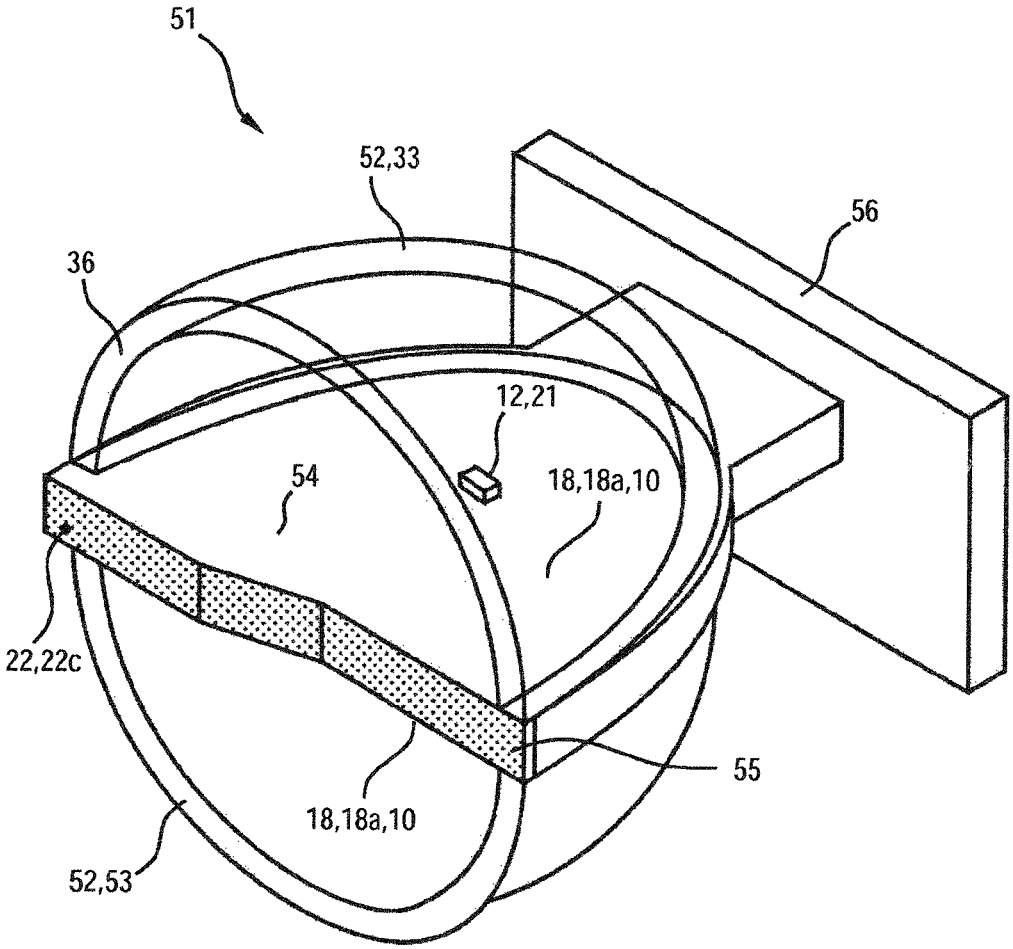
FIG. 7 shows a fourth lighting device in a view obliquely from the front.

FIG. 7 shows a fourth lighting device 51 in a view obliquely from the front. The fourth lighting device 51 differs from the lighting devices 31 and 41 in that the reflector 52 is embodied as a full-shell reflector 52 or 33, 53, which is divided into two parts by the now horizontal, plate-shaped diaphragm 54.

From a different standpoint the reflector 52 may be constructed by two half-shell reflectors 33, 53 or lighting devices which are arranged mirror-symmetrically and are separated by the diaphragm 54 at their principal plane. The resultant two sides (top side and underside) of the lighting device 51 may be activated independently of one another.

The front side 55 of the diaphragm 54 is completely covered with a phosphor layer 22, 22*c*, which brightens a dark stripe between the resulting lower region M1 and upper region M2 of the light emission pattern M.

The rear side of the diaphragm 54 may be fixed via a base 56, e.g. to a heat sink.

Features of different embodiments may be mutually interchanged or combined; by way of example, the phosphor layer 22*a* of the lighting device may include a plurality of phosphors, including differently positioned phosphors.

In this regard, the phosphor layer may be introduced at least partly in at least one front-side depression of the diaphragm.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A lighting device comprising a reflector, which is illuminated by means of at least one light source, and a diaphragm disposed downstream of the reflector and having a rear side facing the reflector and a front side facing away from the reflector, wherein the lighting device comprises at least one additional light source for illuminating the front side of the diaphragm, and the front side of the diaphragm is covered at least in regions with at least one phosphor which is sensitive to light emitted by the at least one additional light source.

2. The lighting device as claimed in claim 1, wherein the at least one phosphor adjoins a top side of the diaphragm at least in sections.

3. The lighting device as claimed in claim 1, wherein a top side of the diaphragm is covered with the at least one phosphor at least in sections.

4. The lighting device as claimed in claim 1, wherein the front side of the diaphragm is covered only partly with the at least one phosphor.

5. The lighting device as claimed in claim 1, wherein the front side of the diaphragm is covered with locally different regions of the at least one phosphor.

6. The lighting device as claimed in claim 1, wherein the at least one phosphor has a thickness that differs over its area.

7. The lighting device as claimed in claim 1, wherein the lighting device comprises a plurality of additional light sources having different wavelengths of the light emitted by them for illuminating the front side of the diaphragm, and the front side of the diaphragm is covered at least in regions with a plurality of phosphors which are selectively sensitive to the light emitted by the additional light sources.

8. The lighting device as claimed in claim 7, wherein the plurality of phosphors cover at least partly different regions of the diaphragm.

9. The lighting device as claimed in claim 1, wherein the at least one phosphor is introduced into at least one depression of the front side.

10. The lighting device as claimed in claim 1, wherein the reflector is embodied as a half-shell reflector.

11. The lighting device as claimed in claim 10, wherein the light reflected by the reflector forms a function light of the lighting device, and the light emitted by the at least one phosphor at least concomitantly forms a further function light of the lighting device.

12. The lighting device as claimed in claim 1, wherein the reflector is embodied as a full-shell reflector, which is divided into two parts by the diaphragm.

13. The lighting device as claimed in claim 1, wherein the diaphragm is embodied as a heat spreading body.

14. The lighting device as claimed in claim 1, wherein the lighting device is a vehicle lighting device.

15. The lighting device as claims in claim 1, wherein the lighting device is a headlight.

* * * * *